US010948859B2

(12) United States Patent
Souda

(10) Patent No.: US 10,948,859 B2
(45) Date of Patent: Mar. 16, 2021

(54) FIXING DEVICE

(71) Applicant: Brother Kogyo Kabushiki Kaisha, Nagoya (JP)

(72) Inventor: Makoto Souda, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/918,006

(22) Filed: Jul. 1, 2020

(65) Prior Publication Data

US 2021/0003954 A1 Jan. 7, 2021

(30) Foreign Application Priority Data

Jul. 5, 2019 (JP) ..... 2019-126442

(51) Int. Cl.
*G03G 15/20* (2006.01)

(52) U.S. Cl.
CPC ..... *G03G 15/2064* (2013.01); *G03G 15/2017* (2013.01); *G03G 15/2053* (2013.01)

(58) Field of Classification Search
CPC ..... G03G 15/2017; G03G 15/2053; G03G 15/2064
See application file for complete search history.

(56) References Cited

U.S. PATENT DOCUMENTS 6,469,279 B1 * 10/2002 Ohtsuka ..... G03G 15/2064 219/216
2014/0169845 A1 * 6/2014 Nakahara ..... G03G 15/2053 399/328
2017/0102651 A1 4/2017 Tanaka et al.
2018/0284664 A1 * 10/2018 Imaizumi ..... G03G 15/2042

FOREIGN PATENT DOCUMENTS

JP H10-134937 A 5/1998
JP 2006-047630 A 2/2006
JP 2009-103881 A 5/2009
JP 2015-197539 A 11/2015
JP 2015-230349 A 12/2015
JP 2017-072780 A 4/2017

* cited by examiner

*Primary Examiner* — Gregory H Curran
(74) *Attorney, Agent, or Firm* — Burr & Brown, PLLC

(57) ABSTRACT

A fixing device includes: a heater including a substrate, and a heating pattern; an endless belt configured to rotate around the heater; and a pressure roller. The endless belt is nipped between the pressure roller and the heater. The endless belt is nipped by the substrate and the pressure roller to form a nip portion including a first portion and a second portion. The length of the first portion in a moving direction of the endless belt at the nip portion is less than that of the second portion in the moving direction. The substrate includes: a third portion located corresponding to the first portion in a longitudinal direction of the substrate; and a fourth portion located corresponding to the second portion in the longitudinal direction. The length of the third portion in the moving direction is less than that of the fourth portion in the moving direction.

13 Claims, 9 Drawing Sheets

FIXING DEVICE

CROSS REFERENCE TO RELATED APPLICATION

The present application claims priority from Japanese Patent Application No. 2019-126442, which was filed on Jul. 5, 2019, the disclosure of which is herein incorporated by reference in its entirety.

BACKGROUND

The following disclosure relates to a fixing device including a heater having a planar plate shape.

There are conventionally known heaters used for a fixing device which include: a substrate having a planar plate shape; and a heating resistor formed on the substrate. The substrate of the heater used in this fixing device has an elongated rectangular shape. There are also known fixing devices including a nip member, a pressure roller, and a belt that is nipped between the nip member and the pressure roller to form a nip portion. This nip portion of the fixing device has an inverse crown shape in which the width of the nip member in the widthwise direction increases with decrease in distance to each end portion of the nip member in the longitudinal direction.

SUMMARY

Incidentally, distribution of pressure in a nip portion is not always uniform in the longitudinal direction of a substrate in fixing devices including a heater having a planar plate shape. Thus, the dimension of the nip portion in the widthwise direction of the substrate is in some cases different between the center and an end portion of the nip portion in the longitudinal direction of the substrate. In this case, if the dimension of the substrate in the widthwise direction is constant, the dimensions of the substrate and the nip portion in the widthwise direction are different from each other, which may lead to deterioration of the thermal efficiency of the heater.

Accordingly, an aspect of the disclosure relates to a fixing device with reduced deterioration of the thermal efficiency of a heater.

In one aspect of the disclosure, a fixing device includes: a heater including a substrate, and a heating pattern constituted by a heating resistor on the substrate; an endless belt configured to rotate around the heater; and a pressure roller, the endless belt being nipped between the pressure roller and the heater. The endless belt is nipped by and between the substrate and the pressure roller to form a nip portion including a first portion and a second portion located apart from the first portion in a longitudinal direction of the substrate. A length of the first portion in a moving direction of the endless belt at the nip portion is less than a length of the second portion in the moving direction. The substrate includes: a third portion located corresponding to the first portion in the longitudinal direction; and a fourth portion located corresponding to the second portion in the longitudinal direction. A length of the third portion in the moving direction is less than a length of the fourth portion in the moving direction.

In another aspect of the disclosure, a fixing device includes: a heater including a substrate, and a heating pattern constituted by a heating resistor on the substrate; an endless belt configured to rotate around the heater; and a pressure roller, the endless belt being nipped between the pressure roller and the heater. The pressure roller includes: a small-diameter portion; and a large-diameter portion located apart from the small-diameter portion in a longitudinal direction of the substrate, the large-diameter portion having a diameter that is greater than that of the small-diameter portion. The substrate includes: a third portion located corresponding to the small-diameter portion in the longitudinal direction; and a fourth portion located corresponding to the large-diameter portion in the longitudinal direction. A length of the third portion in a widthwise direction of the substrate is less than a length of the fourth portion in the widthwise direction.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

EMBODIMENT

Figure 1:
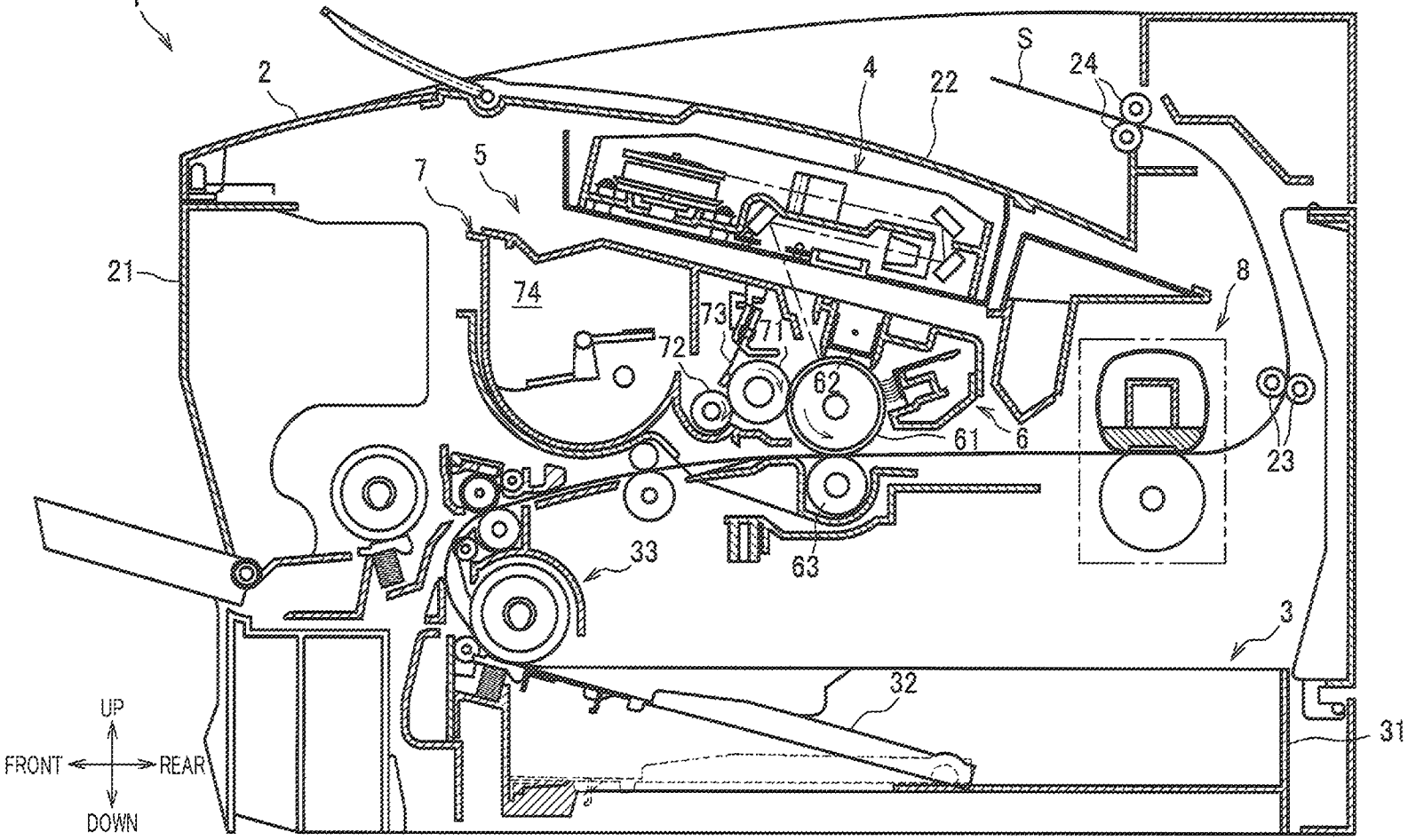
FIG. 1 is a cross-sectional view of a laser printer according to one embodiment.

Hereinafter, there will be described one embodiment by reference to the drawings. As illustrated in FIG. 1, a laser printer 1 includes a supplier 3, an exposing device 4, a process cartridge 5, and a fixing device 8 in a housing 2.

The supplier 3 is provided at a lower portion of the housing 2 and includes a supply tray 31 for accommodating sheets S, a pressing plate 32, and a supply mechanism 33. The sheet S accommodated in the supply tray 31 is moved upward by the pressing plate 32 and supplied into the process cartridge 5 by the supply mechanism 33.

The exposing device 4 is disposed at an upper portion of the housing 2 and includes a light source device, not illustrated, and a polygon mirror, a lens, a reflective mirror, and so on illustrated without reference numerals. The exposing device 4 exposes a surface of a photoconductor drum 61 by scanning the surface of the photoconductor drum 61 at high speed with a light beam emitted from the light source device based on image data.

The process cartridge 5 is disposed below the exposing device 4 and removably mountable in the housing 2 through an opening that is formed when opening a front cover 21 provided on the housing 2. The process cartridge 5 includes a drum unit 6 and a developing unit 7. The drum unit 6 includes the photoconductor drum 61, a charging unit 62, and a transfer roller 63. The developing unit 7 is mountable to and removable from the drum unit 6 and includes a developing roller 71, a supply roller 72, a layer-thickness limiting blade 73, and a container 74 containing toner.

In the process cartridge 5, the surface of the photoconductor drum 61 is uniformly charged by the charging unit 62 and then exposed by the light beam emitted from the exposing device 4 to form an electrostatic latent image on the photoconductor drum 61 based on the image data. The toner in the container 74 is supplied to the developing roller 71 by the supply roller 72 so as to enter a position between the developing roller 71 and the layer-thickness limiting blade 73, so that the toner is born on the developing roller 71 as a thin layer having a specific thickness. The toner born on the developing roller 71 is supplied from the developing roller 71 to the electrostatic latent image formed on the photoconductor drum 61. This visualizes the electrostatic latent image, thereby forming a toner image on the photoconductor drum 61. The sheet S is thereafter conveyed between the photoconductor drum 61 and the transfer roller 63, so that the toner image formed on the photoconductor drum 61 is transferred to the sheet S.

The fixing device 8 is disposed downstream of the process cartridge 5 in a conveying direction of the sheet S. The toner image is fixed while the sheet S to which the toner image is transferred is passing through the fixing device 8. The sheet S to which the toner image is fixed is discharged onto an output tray 22 by conveying rollers 23, 24.

Figure 2:
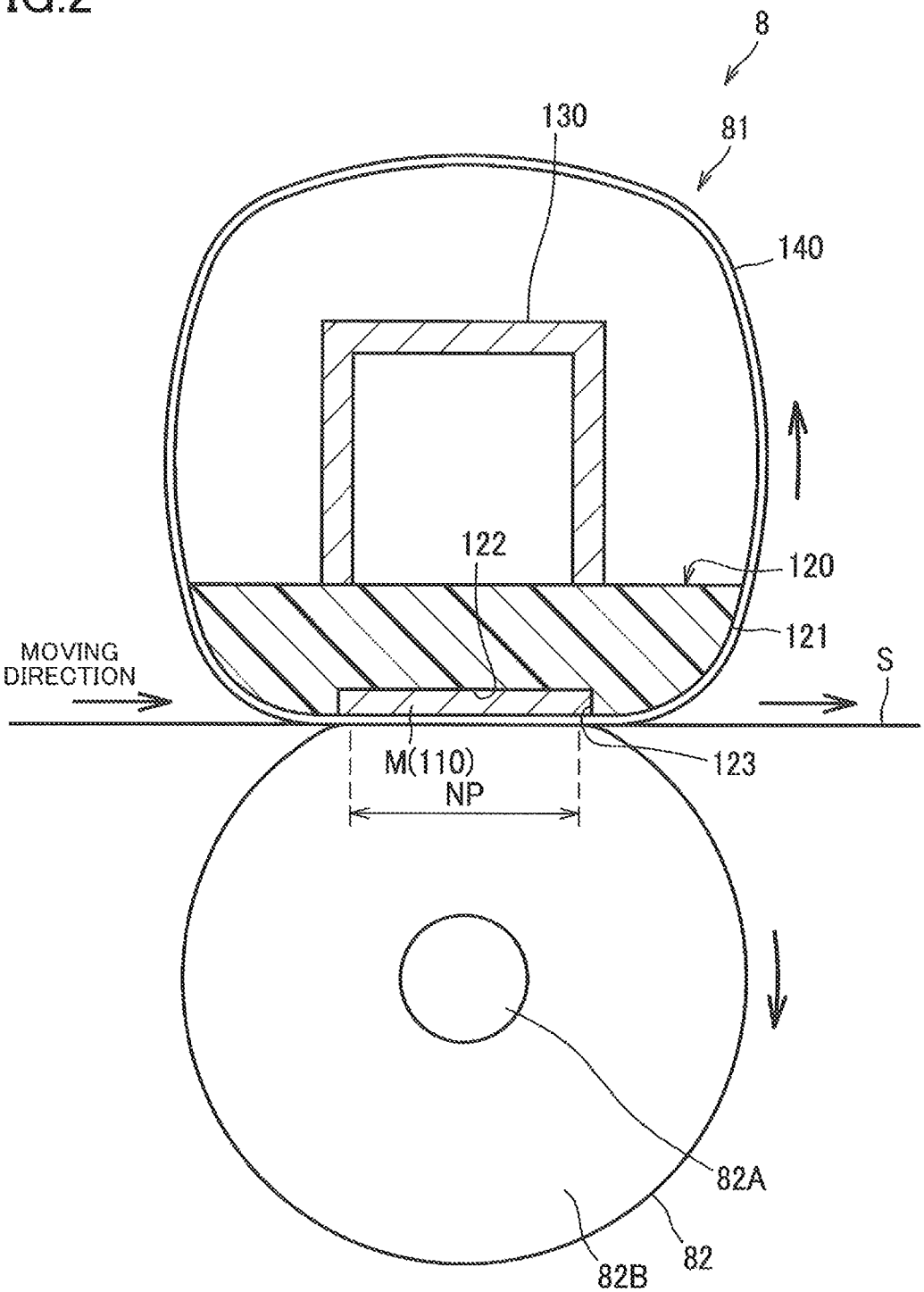
FIG. 2 is a cross-sectional view of a fixing device.

As illustrated in FIG. 2, the fixing device 8 includes a heating unit 81 and a pressure roller 82. One of the heating unit 81 and the pressure roller 82 is urged to the other by an urging mechanism, not illustrated.

The heating unit 81 includes a heater 110, a holder 120, a stay 130, and a belt 140. The heater 110 is of a planar plate shape and supported by the holder 120. It is noted that the configuration of the heater 110 will be described later in detail.

The holder 120 is formed of resin and has a guide surface 121 being in contact with an inner circumferential surface of the belt 140 to guide the belt 140. The holder 120 has heater supporting surfaces 122, 123 supporting the heater 110. The heater supporting surface 122 supports the heater 110 by contacting one of opposite surfaces of the heater 110 which is farther from the pressure roller 82 than the other. The heater supporting surface 123 supports the heater 110 by contacting the heater 110 in the conveying direction of the sheet S.

The stay 130 is a member for supporting the holder 120 and formed by bending a plate member having stiffness greater than that of the holder 120, e.g., steel sheet, in a substantially U-shape in cross section.

The belt 140 is an endless belt having heat resistance and flexibility and including a base member and a fluororesin layer covering the base member. The base member may be formed of any of heatproof resin such as polyimide and metal such as stainless steel. The heater 110, the holder 120, and the stay 130 are disposed on an inner side of the belt 140. The belt 140 rotates around the heater 110 in a state in which the inner circumferential surface of the belt 140 is in contact with the heater 110.

The pressure roller 82 includes a metal shaft 82A and an elastic layer 82B covering the shaft 82A. The belt 140 is nipped between the pressure roller 82 and the heater 110 to form a nip portion NP for heating and pressurizing the sheet S.

The pressure roller 82 is driven and rotated by a driving force transmitted from a motor, not illustrated, provided in the housing 2. When the pressure roller 82 is driven, the belt 140 is rotated by a frictional force between the pressure roller 82 and the belt 140 (or the sheet S). As a result, the sheet S to which the toner image is transferred is conveyed between the pressure roller 82 and the heated belt 140, whereby the toner image is heat-fixed.

Figure 3A:
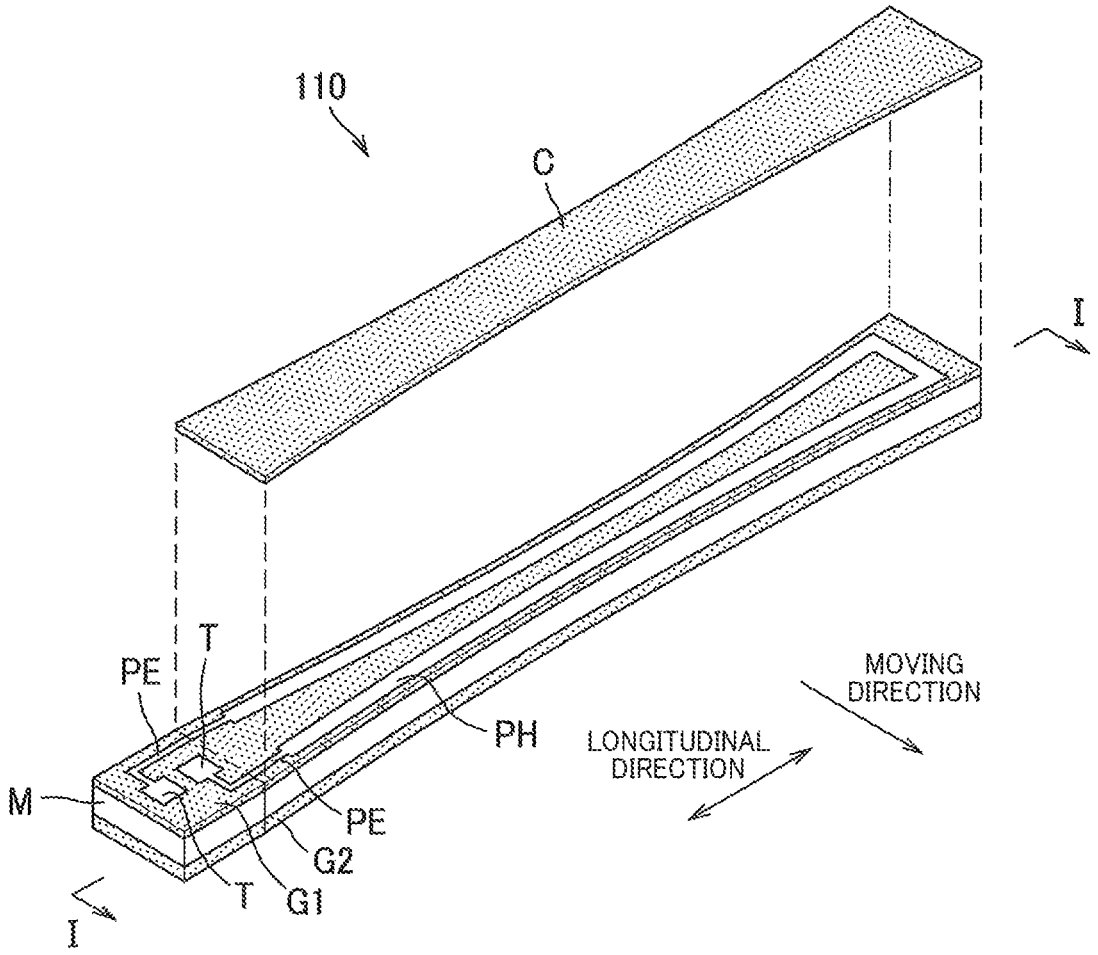
FIG. 3A is a partly-exploded perspective view of a heater.
Figure 3B:
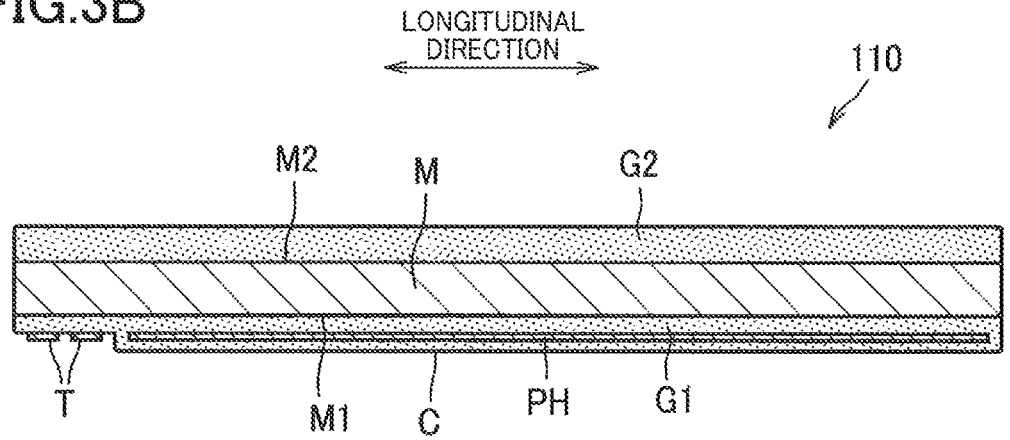
FIG. 3B is a cross-sectional view taken along line I-I.

As illustrated in FIGS. 3A and 3B, the heater 110 includes a substrate M, a first insulating layer G1, a second insulating layer G2, a heating pattern PH, power-supply patterns PE, two power-supply terminals T, and a protecting layer C.

The substrate M has an elongated shape. The substrate M is formed of metal. In the present embodiment, the substrate M is formed of stainless steel. The substrate M has opposite surfaces, namely, a first surface M1 and a second surface M2. The first surface M1 and the second surface M2 are orthogonal to a direction in which the heating unit 81 and the pressure roller 82 are arranged. In the present embodiment, the heater 110 is disposed such that the first surface M1 of the substrate M faces toward the pressure roller 82. In the following description, the longitudinal direction and the widthwise direction of the substrate M may be referred to simply as "longitudinal direction" and "widthwise direction", respectively. In the present embodiment, the widthwise direction coincides with the direction in which the belt 140 moves at the nip portion NP.

The substrate M is rectangular in cross section orthogonal to a moving direction. The first surface M1 extends straight in cross section orthogonal to the moving direction (see FIG. 3B). The substrate M is rectangular in cross section orthogonal to the longitudinal direction. The first surface M1 extends straight in cross section orthogonal to the longitudinal direction (see FIG. 2).

Each of the first insulating layer G1 and the second insulating layer G2 is an insulating member formed of glass material. The first insulating layer G1 is provided on the first surface M1 of the substrate M. The second insulating layer G2 is provided on the second surface M2 of the substrate M.

The heating pattern PH, the power-supply patterns PE, and the power-supply terminals T are provided on an opposite side of the first insulating layer G1 from the substrate M. The heating pattern PH is a heating resistor that generates heat when energized. In the present embodiment, the heating pattern PH extends along opposite ends of the substrate M in the widthwise direction and one end of the substrate M in the longitudinal direction so as to have a U-shape turned at the one end of the substrate M in the longitudinal direction.

The two power-supply terminals T are for supplying electricity to the heating pattern PH and provided at one end portion of the heater 110 in the longitudinal direction. The power-supply terminals T are connectable to a connector, not illustrated, so as to be connected to a power source, not illustrated, in the housing 2 by wires of the connector.

Each of the power-supply patterns PE is a pattern for electrically connecting a corresponding one of the power-supply terminals T and the heating pattern PH to each other. Each of the power-supply patterns PE and the power-supply terminals T is formed of a conductive material that is less than a material of the heating patterns PH in resistance value.

The protecting layer C is an insulating member formed of glass material and covering the heating pattern PH and portions of the power-supply patterns PE. The protecting layer C contacts the belt 140. It is noted that the protecting layer C is preferably formed of a material having a high slidability on the inner circumferential surface of the belt 140, such as a glass.

Figure 4:
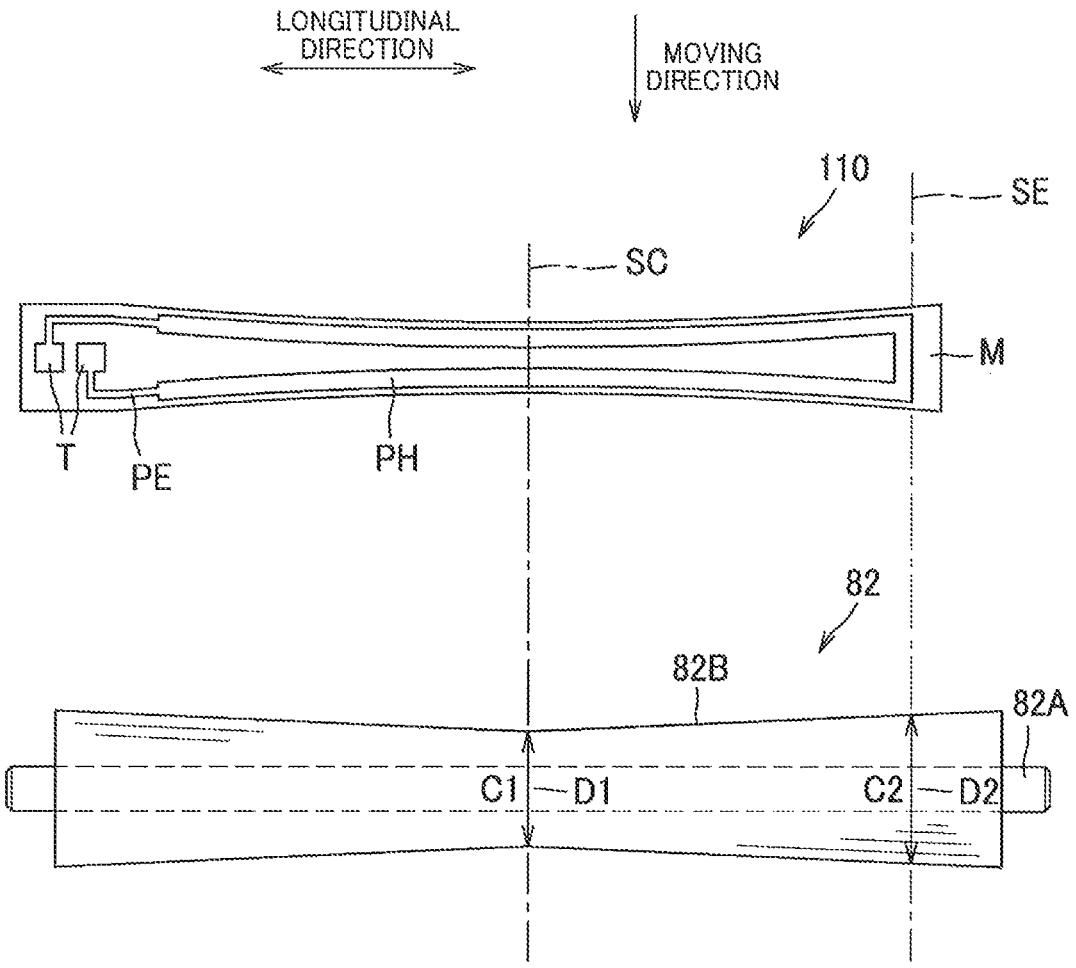
FIG. 4 is a view of the heater and a pressure roller viewed in a direction orthogonal to a longitudinal direction and a moving direction.

As illustrated in FIG. 4, the pressure roller 82 includes a small-diameter portion D1 and a large-diameter portion D2 located apart from the small-diameter portion D1 in the longitudinal direction. The diameter C2 of the large-diameter portion D2 is greater than the diameter C1 of the small-diameter portion D1 (C1<C2). In the present embodiment, the small-diameter portion D1 is located at the center of the pressure roller 82 in the longitudinal direction, and the large-diameter portion D2 is located at an end portion of the pressure roller in the longitudinal direction. The center of the pressure roller 82 in the longitudinal direction corresponds to the center SC of the largest one of image-fixable sheets S. The end portion of the pressure roller 82 in the longitudinal direction corresponds to an end portion SE of the largest one of image-fixable sheets S. That is, the pressure roller 82 is of an inverse crown shape having a diameter that increases with increase in distance in the longitudinal direction from the center SC in the longitudinal direction. Thus, when the pressure roller 82 is rotated, the sheet S is conveyed with its opposite ends pulled outward in the longitudinal direction, leading to less creases generated in the sheet S.

Figure 5A:
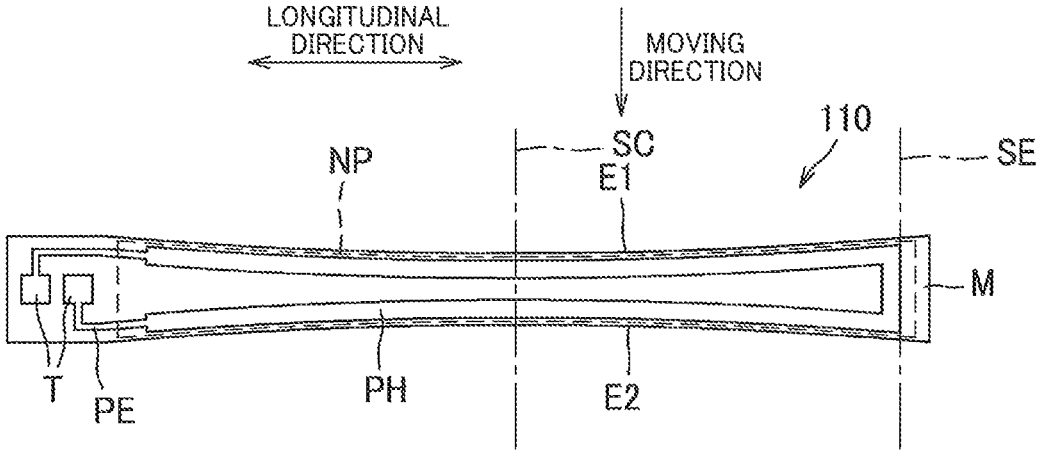
FIG. 5A is a view of the heater, a nip portion, and a heating pattern viewed in the direction orthogonal to the longitudinal direction and the moving direction.
Figure 5B:
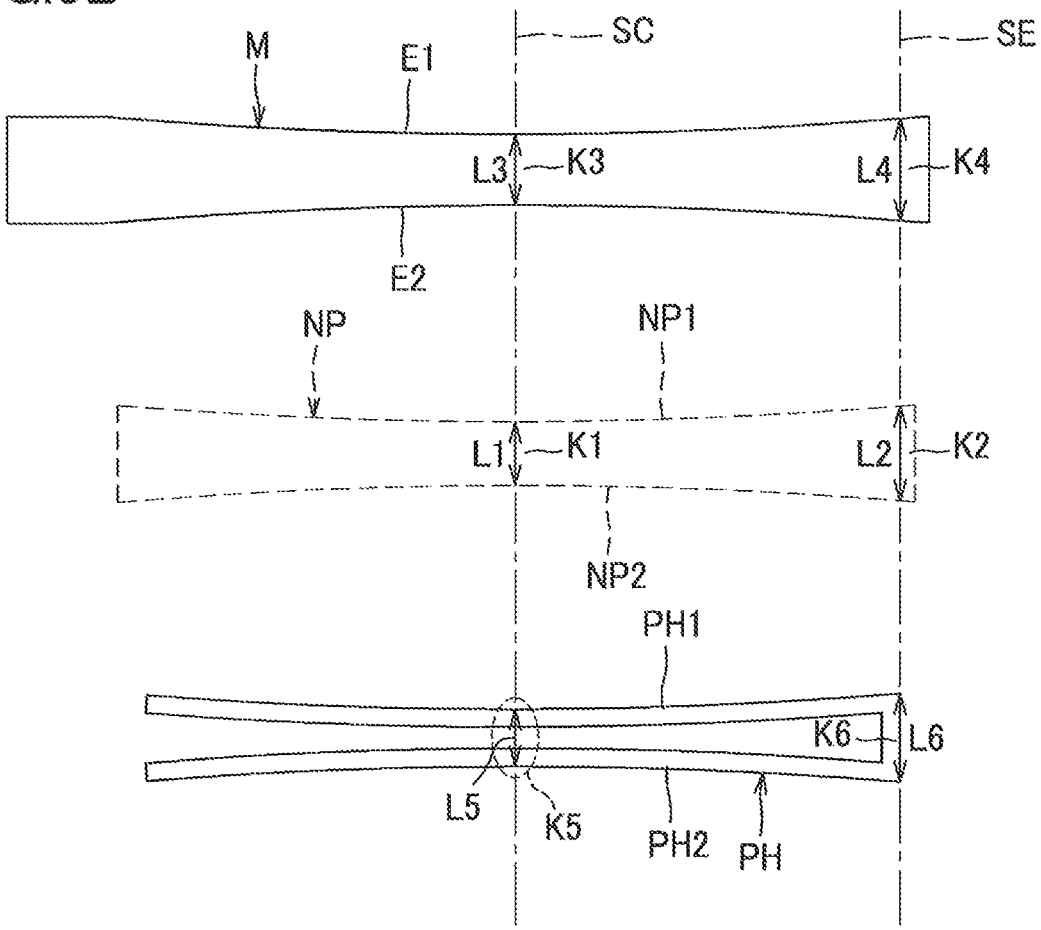
FIG. 5B is a view representing the dimensions of central portions and end portions of the heater, the nip portion, and the heating pattern.

As described above, the belt 140 is nipped between the substrate M of the heater 110 and the pressure roller 82 so as to form the nip portion NP (see FIG. 2). The nip portion NP is formed in a state in which one of the heating unit 81 and the pressure roller 82 is urged toward the other, that is, a predetermined urging force is applied from the one to the other, making it possible to fix a toner image to the sheet S. As indicated by the broken lines in FIGS. 5A and 5B, the nip portion NP is located within a region of the substrate M in the moving direction of the belt 140 at the nip portion NP which may be hereinafter referred to simply as "moving direction".

The nip portion NP includes a first portion K1 and a second portion K2 located apart from the first portion K1 in the longitudinal direction of the substrate M. The dimension L1 of the first portion K1 of the nip portion NP in the moving direction is less than the dimension L2 of the second portion K2 of the nip portion NP in the moving direction (L1<L2).

In the present embodiment, the first portion K1 is located at the center of the nip portion NP in the longitudinal direction, and the second portion K2 is located at an end portion of the nip portion NP in the longitudinal direction. The nip portion NP is not rectangular. Specifically, the nip portion NP is of a shape having a diameter in the moving direction which increases with increase in distance in the longitudinal direction from the center of the nip portion NP in the longitudinal direction. Each of an upstream edge NP1 and a downstream edge NP2 of the nip portion NP in the moving direction has an arc shape.

The substrate M includes a third portion K3, as one example of a narrow portion, corresponding to the first portion K1 in the longitudinal direction, and a fourth portion K4, as one example of a wide portion, corresponding to the second portion K2 in the longitudinal direction. The dimension L1 of the first portion K1 in the moving direction is less than the dimension L3 of the third portion K3 in the moving direction (L1<L3). The dimension L2 of the second portion K2 in the moving direction is less than the dimension L4 of the fourth portion K4 in the moving direction (L2<L4).

The substrate M of the heater 110 is not rectangular. Specifically, the substrate M is of a shape having a diameter in the moving direction which increases with increase in distance in the longitudinal direction from the center of the substrate M in the longitudinal direction. Each of an upstream edge E1 and a downstream edge E2 of the substrate M in the moving direction has an arc shape. The dimension L3 of the third portion K3 in the moving direction is less than the dimension L4 of the fourth portion K4 in the moving direction (L3<L4).

The heating pattern PH is located within a region of the nip portion NP in the moving direction. The heating pattern PH is of a shape having a diameter in the moving direction which increases with increase in distance in the longitudinal direction from the center of the heating pattern PH in the longitudinal direction. Each of an upstream end PH1 and a downstream end PH2 of the heating pattern PH in the moving direction has an arc shape.

The heating pattern PH includes a fifth portion K5, as one example of a close portion, corresponding to the first portion K1, and a sixth portion K6, as one example of an apart portion, corresponding to the second portion K2. The fifth portion K5 is enclosed by the broken line in FIG. 5B. In the present embodiment, the fifth portion K5 is located at the center of the heating pattern PH in the longitudinal direction, and the sixth portion K6 is located at an end portion of the heating pattern PH in the longitudinal direction.

Here, the dimension of the heating pattern PH in the moving direction will be explained. The dimension of the heating pattern PH in the moving direction is a dimension from the upstream end PH1 to the downstream end PH2 of the heating pattern PH in the moving direction.

The dimension L5 of the fifth portion K5 in the moving direction is less than the dimension L6 of the sixth portion K6 in the moving direction (L5<L6). The dimension L5 of the fifth portion K5 in the moving direction is less than the dimension L1 of the first portion K1 in the moving direction (L5<L1). The dimension L6 of the sixth portion K6 in the moving direction is less than the dimension L2 of the second portion K2 in the moving direction (L6<L2).

There will be next described operations and effects of the fixing device 8 according to the present embodiment. In the fixing device 8, the dimension L3 of the third portion K3 is less than the dimension L4 of the fourth portion K4 in the moving direction in the substrate M of the heater 110 (L3<L4), and the shape of the substrate M corresponds to that of the nip portion NP. This reduces a portion of the substrate M of the heater 110 at which the nip portion NP is not formed. This enables efficient heat transmission to the sheet S, thereby preventing deterioration of the thermal efficiency of the heater 110 in the fixing device 8.

The dimension L6 of the sixth portion K6 is greater than the dimension L5 of the fifth portion K5 in the dimension of the heating pattern PH in the moving direction. Thus, the shape of the heating pattern PH corresponds to the shape of the substrate, making it possible to efficiently transmit heat generated by the heating pattern PH, to the nip portion NP. This prevents deterioration of the thermal efficiency of the heater 110.

The nip portion NP is located within the region of the substrate M in the moving direction, making it possible to efficiently transmit heat of the substrate M of the heater 110 to the nip portion NP.

The heating pattern PH is located within the region of the nip portion NP in the moving direction, making it possible to efficiently transmit heat of the heating pattern PH to the nip portion NP.

The substrate M is formed of metal, facilitating changing the dimensions of the first portion K1 and the second portion K2 in the moving direction by press working, for example. This results in reduced cost of the substrate M.

While the embodiment has been described above, it is to be understood that the disclosure is not limited to the details of the illustrated embodiment, but may be embodied with various changes and modifications, which may occur to those skilled in the art, without departing from the spirit and scope of the disclosure. It is noted that the same reference numerals as used in the above-described embodiment are used to designate the corresponding elements of the following modifications, and an explanation of which is dispensed with.

Figure 6A:
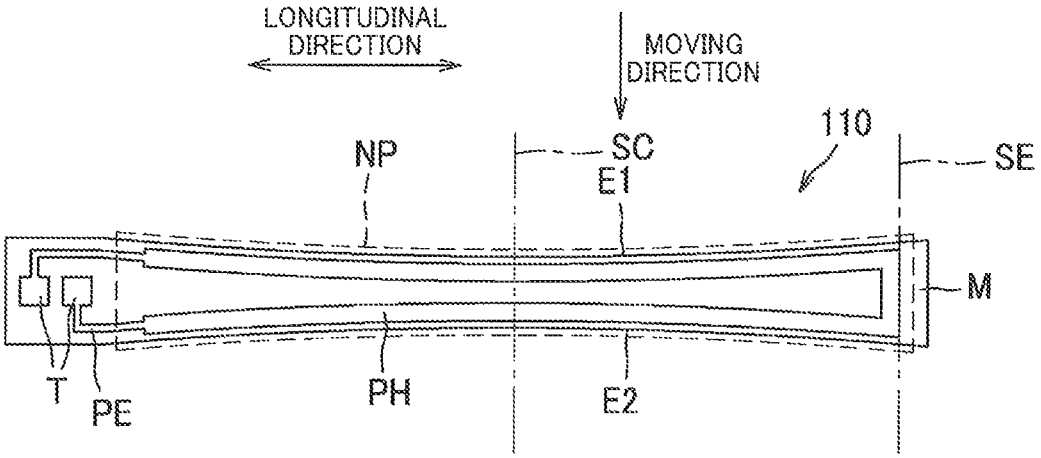
FIGS. 6A and 6B are views in a first modification, corresponding respectively to FIGS. 5A and 5B.
Figure 6B:
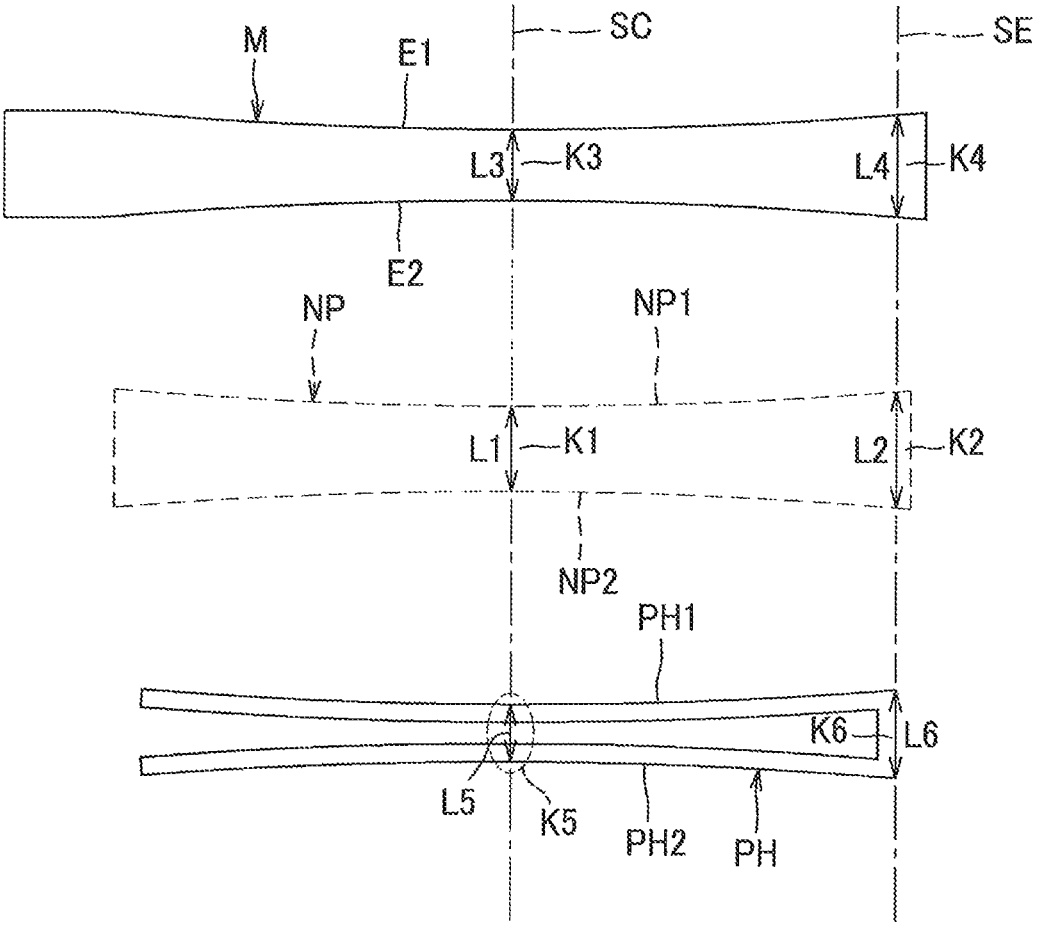

While the nip portion NP is located within the region of the substrate M in the moving direction in the above-described embodiment, the nip portion NP need not be located within the region of the substrate M in the moving direction. For example, in a first modification illustrated in FIG. 6A, the nip portion NP of the heater 110 is not located within the region of the substrate M in the moving direction and extends off the region of the substrate M in the moving direction. The nip portion NP extends over the substrate M and at least a portion of the guide surface 121 of the holder 120 (see FIG. 2). The urging force for urging one of the heating unit 81 and the pressure roller 82 to the other is greater in this first modification than in the above-described embodiment.

Specifically, the dimension L1 of the first portion K1 of the nip portion NP in the moving direction is greater than the dimension L3 of the third portion K3 of the substrate M in the moving direction (L1>L3). The dimension L2 of the second portion K2 of the nip portion NP in the moving direction is greater than the dimension L4 of the fourth portion K4 of the substrate M in the moving direction (L2>L4). Also in this first modification, the dimension L3 of the third portion K3 is less than the dimension L4 of the fourth portion K4 in the moving direction in the substrate M (L3<L4), and the shape of the substrate M corresponds to that of the nip portion NP. This reduces a portion of the substrate M of the heater 110 at which the nip portion NP is not formed. This enables efficient heat transmission to the sheet S, thereby preventing deterioration of the thermal efficiency of the heater in the fixing device.

In the above-described embodiment, the first portion K1 of the nip portion NP is located at the center of the nip portion NP in the longitudinal direction, and the second portion K2 is located at the end portion of the nip portion NP in the longitudinal direction. However, the fixing device may be configured such that the first portion K1 is located at an end portion of the nip portion NP in the longitudinal direction, and the second portion K2 is located at the center of the nip portion NP in the longitudinal direction.

Figure 7A:
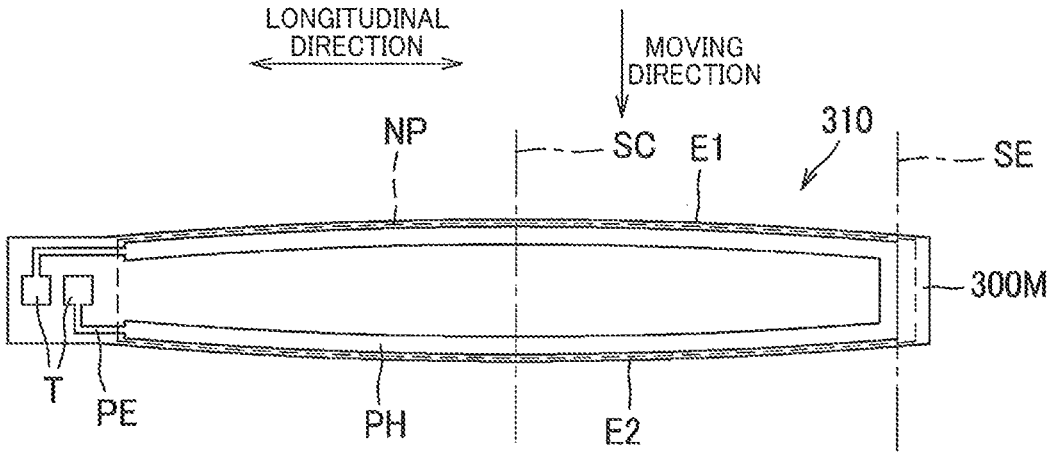
FIGS. 7A and 7B are views in a second modification, corresponding respectively to FIGS. 5A and 5B.
Figure 7B:
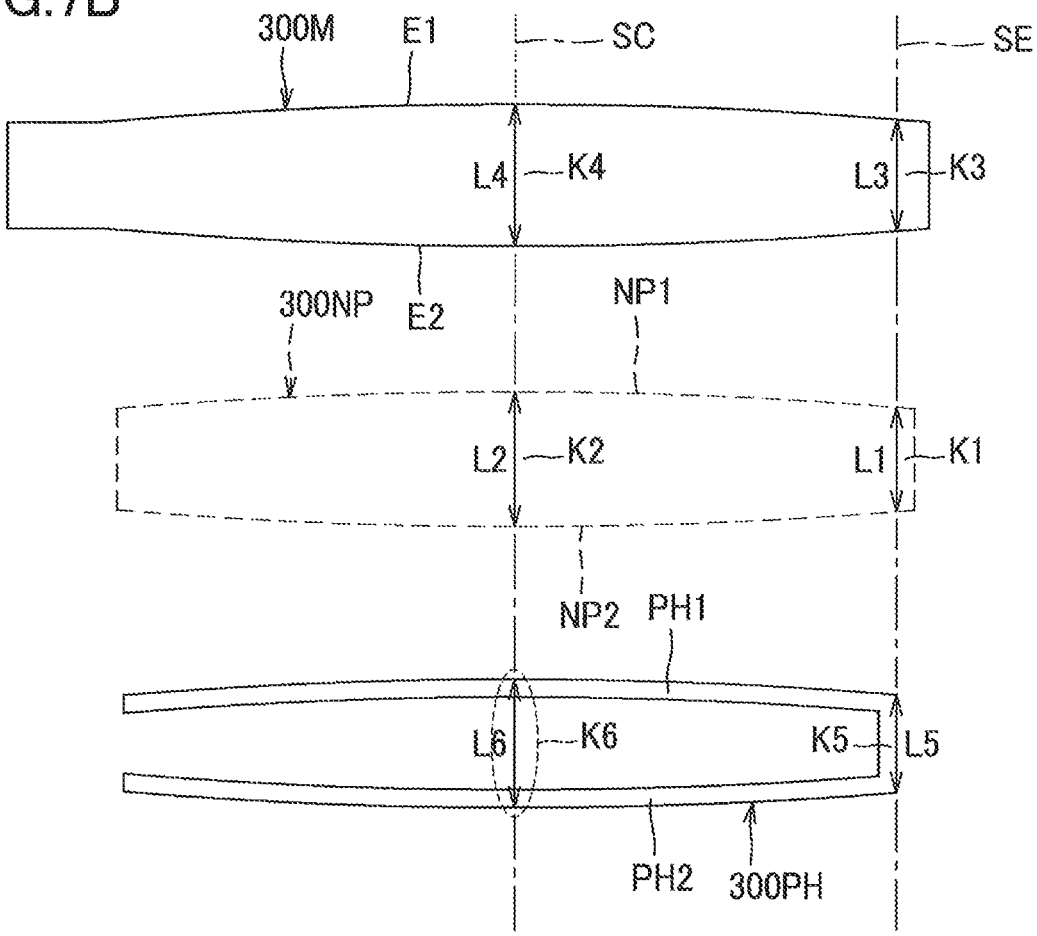

For example, in a second modification illustrated in FIGS. 7A and 7B, a heater 310 is configured such that the first portion K1 of a nip portion 300NP is located at an end portion of the nip portion 300NP in the longitudinal direction, and the second portion K2 of the nip portion 300NP is located at the center of the nip portion 300NP in the longitudinal direction. The nip portion 300NP is of a shape having a diameter in the moving direction which decreases with increase in distance in the longitudinal direction from the center of the nip portion 300NP in the longitudinal direction. Each of the upstream edge NP1 and the downstream edge NP2 of the nip portion 300NP in the moving direction has an arc shape.

In the heater 310, the third portion K3 of a substrate 300M is located at an end portion of the substrate 300M in the longitudinal direction, and the fourth portion K4 of the substrate 300M is located at the center of the substrate 300M in the longitudinal direction. The substrate 300M is of a shape having a diameter in the moving direction which decreases with increase in distance in the longitudinal direction from the center of the substrate 300M in the longitudinal direction. Each of the upstream edge E1 and the downstream edge E2 of the substrate 300M in the moving direction has an arc shape.

In the heater 310, the fifth portion K5 of a heating pattern 300PH is located at an end portion of the heating pattern 300PH in the longitudinal direction, and the sixth portion K6 of the heating pattern 300PH is located at the center of the heating pattern 300PH in the longitudinal direction. The heating pattern 300PH is of a shape having a diameter in the moving direction which decreases with increase in distance in the longitudinal direction from the center of the heating pattern 300PH in the longitudinal direction. Each of the upstream end PH1 and the downstream end PH2 of the heating pattern 300PH in the moving direction has an arc shape.

Like the above-described embodiment, this second modification satisfies the following relationships: L1<L2, L3<L4, L5<L6, L5<L1<L3, and L6<L2<L4.

Also in the second modification described above, the shape of the substrate 300M corresponds to that of the nip portion 300NP. This reduces a portion of the substrate 300M of the heater 310 at which the nip portion 300NP is not formed. This enables efficient heat transmission to the sheet, thereby preventing deterioration of the thermal efficiency of the heater in the fixing device.

In the fixing device according to the second modification, for example, a pressure roller, not illustrated, is of a crown shape having a diameter that decreases with increase in distance in the longitudinal direction from the center in the longitudinal direction. In the fixing device including the pressure roller having the crown shape, the nip portion 300NP of the heater 310 is of a crown shape having a diameter that decreases with increase in distance in the longitudinal direction from the center in the longitudinal direction.

Figure 8A:
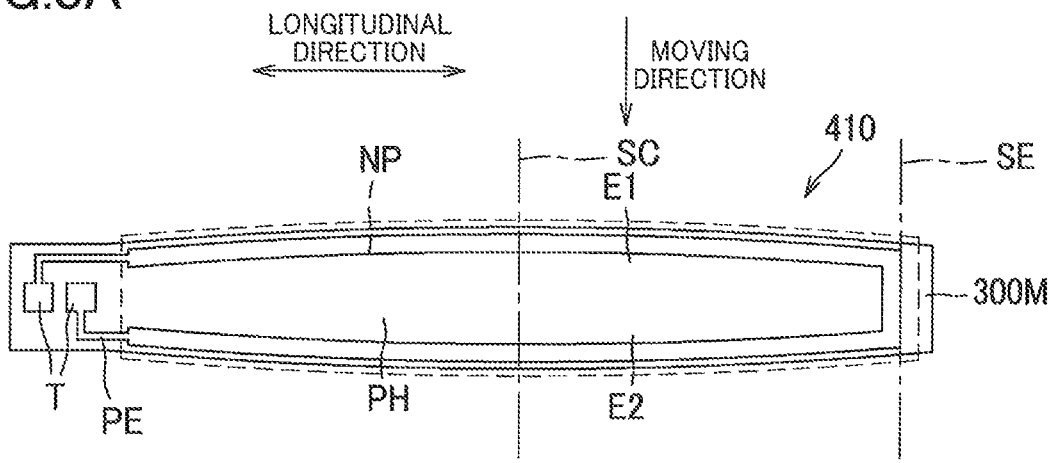
FIGS. 8A and 8B are views in a third modification, corresponding respectively to FIGS. 5A and 5B.
Figure 8B:
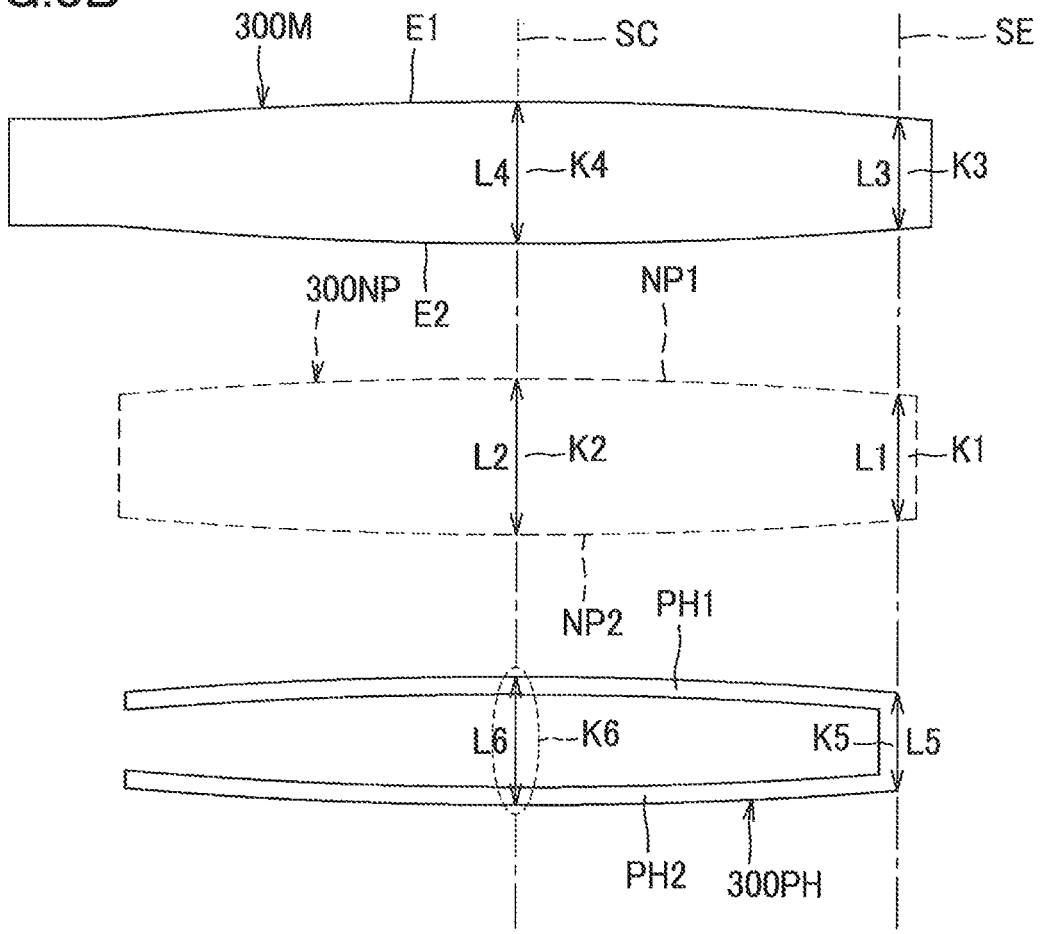

In the second modification, the nip portion NP is located within the region of the substrate M in the moving direction. As illustrated in FIGS. 8A and 8B, however, the nip portion NP need not be located within the region of the substrate in the moving direction of the belt 140. The urging force for urging one of the heating unit 81 and the pressure roller 82 to the other is greater in this third modification than in the second modification. As in the first modification, a heater 410 in the third modification satisfies the following relationships: L5<L3<L1, and L6<L4<L2. This third modification also prevents deterioration of the thermal efficiency of the heater in the fixing device.

Figure 9A:
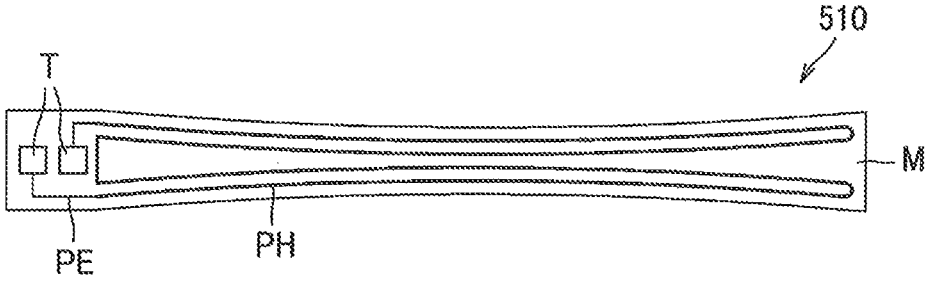
FIGS. 9A through 9D are views in respective fourth to seventh modifications, corresponding respectively to FIGS. 5A and 5B.

While the heating pattern PH has the U-shape turned at one end of the substrate M in the longitudinal direction in the above-described embodiment, the shape of the heating pattern is not limited in particular. For example, as in modifications illustrated in FIGS. 9A and 9B, the heating pattern PH may have a bellows shape turned at opposite ends of the substrate M in the longitudinal direction. Alternatively, as in modifications illustrated in FIGS. 9C and 9D, the heating pattern PH may have a bellows shape turned at opposite ends of the substrate M in the widthwise direction.

Figure 9B:
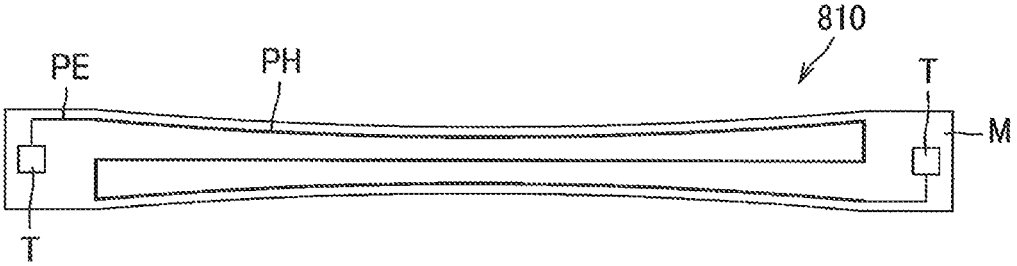
Figure 9C:
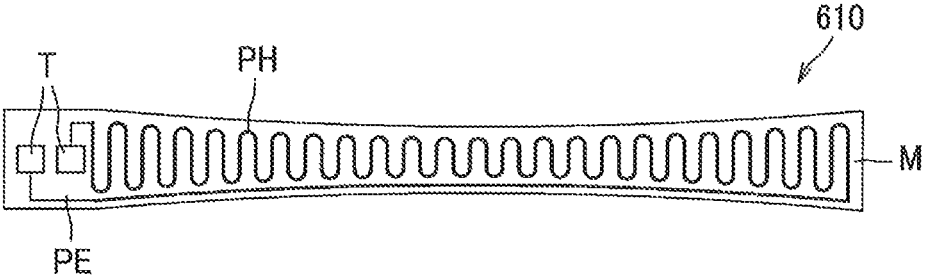
Figure 9D:
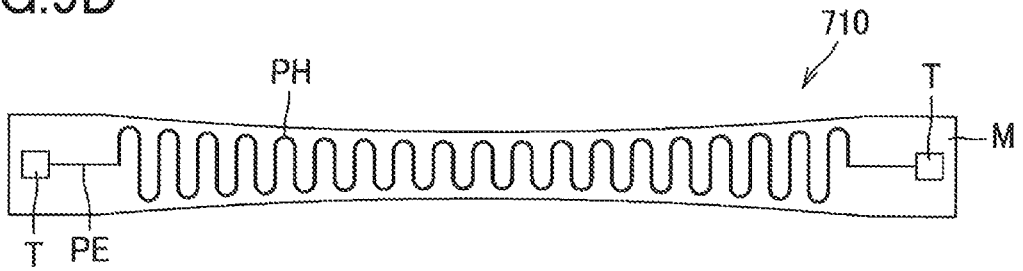

While the two power-supply terminals T are provided at the one end portion of the heater 110 in the longitudinal direction in the above-described embodiment, as in the modifications illustrated in FIGS. 9B and 9D, the two power-supply terminals T may be provided respectively at opposite end portions of the heater in the longitudinal direction, for example.

While the protecting layer C is provided in the above-described embodiment, the present disclosure is not limited to this configuration, and the protecting layer C may not be provided. That is, the heating patterns may contact the belt.

While the image is fixed to the sheet S by passage of the sheet S through the nip portion NP formed between the heating unit 81 and the pressure roller 82 in the above-described embodiment, the present disclosure is not limited to this configuration, and the image may be fixed to the sheet S by passage of the sheet S through a position different from the nip portion NP formed between the heating unit 81 and the pressure roller 82.

In the above-described embodiment, the pressure roller 82 includes the small-diameter portion D1 and the large-diameter portion D2, whereby the respective dimensions of the first portion K1 and the second portion K2 of the nip portion NP in the moving direction are different from each other. In some cases, however, the respective dimensions of the first portion K1 and the second portion K2 of the nip portion NP in the moving direction are different from each other even in the case where the pressure roller does not include the small-diameter portion and the large-diameter portion, and the diameter is the same at the center and the end portions of the nip portion. For example, if the shaft of the pressure roller is bent and deformed when the pressure roller is pressed toward the heating unit 81, the respective dimensions of the first portion K1 and the second portion K2 of the nip portion NP in the moving direction are different from each other even in the case where the diameter is the same at the center and the end portions of the nip portion. The present disclosure may be employed to such a case.

While the surface of the heater 110 on which the heating pattern PH is formed is in contact with the belt 140 in the above-described embodiment, the present disclosure is not limited to this configuration. For example, a surface of the second insulating layer G2 on which the heating pattern PH is not formed in the heater 110 may contact the belt 140. This case does not require the protecting layer C for facilitating sliding on the belt 140.

In the above-described embodiment, the third portion K3 of the substrate M corresponds to the first portion K1 of the nip portion NP, and the fourth portion K4 of the substrate M corresponds to the second portion K2 of the nip portion NP. However, the fixing device may be configured such that the third portion K3 of the substrate M corresponds to the small-diameter portion D1 of the pressure roller 82, and the fourth portion K4 of the substrate M corresponds to the large-diameter portion D2 of the pressure roller 82.

While the present disclosure is applied to the laser printer 1 in the above-described embodiment, the present disclosure is not limited to this configuration. For example, the present disclosure may be applied to other types of image forming apparatuses, such as copying machines and multi-function peripherals.

The elements in the above-described embodiments and the modifications may be combined as needed.

What is claimed is:

1. A fixing device, comprising:

a heater comprising a substrate, and a heating pattern constituted by a heating resistor on the substrate;

an endless belt configured to rotate around the heater; and a pressure roller, the endless belt being nipped between the pressure roller and the heater, wherein the endless belt is nipped by and between the substrate and the pressure roller to form a nip portion comprising a first portion and a second portion located apart from the first portion in a longitudinal direction of the substrate, wherein a length of the first portion in a moving direction of the endless belt at the nip portion is less than a length of the second portion in the moving direction, wherein the substrate comprises:

a third portion located corresponding to the first portion in the longitudinal direction; and a fourth portion located corresponding to the second portion in the longitudinal direction, and wherein a length of the third portion in the moving direction is less than a length of the fourth portion in the moving direction.

2. The fixing device according to claim 1, wherein a length, in the moving direction, of a fifth portion of the heating pattern which corresponds to the third portion is less than a length, in the moving direction, of a sixth portion of the heating pattern which corresponds to the fourth portion.

3. The fixing device according to claim 1, wherein the nip portion is located within a region occupied by the substrate in the moving direction.

4. The fixing device according to claim 1, wherein the heating pattern is located within a region occupied by the nip portion in the moving direction.

5. The fixing device according to claim 1, wherein the first portion is located at a center of the nip portion in the longitudinal direction, and wherein the second portion is located apart from the center in the longitudinal direction.

6. The fixing device according to claim 1, wherein at least one of an upstream edge and a downstream edge of the substrate in the moving direction has an arc shape.

7. The fixing device according to claim 1, wherein the substrate is metal.

8. A fixing device, comprising:

a heater comprising a substrate, and a heating pattern constituted by a heating resistor on the substrate;

an endless belt configured to rotate around the heater; and a pressure roller, the endless belt being nipped between the pressure roller and the heater, wherein the pressure roller comprises:

a small-diameter portion; and a large-diameter portion located apart from the small-diameter portion in a longitudinal direction of the substrate, the large-diameter portion having a diameter that is greater than that of the small-diameter portion, wherein the substrate comprises:

a narrow portion located corresponding to the small-diameter portion in the longitudinal direction; and a wide portion located corresponding to the large-diameter portion in the longitudinal direction, and wherein a length of the narrow portion in a widthwise direction of the substrate is less than a length of the wide portion in the widthwise direction.

9. The fixing device according to claim 8, wherein the small-diameter portion is located at a center of the pressure roller in the longitudinal direction, and wherein the large-diameter portion is located apart from the center of the pressure roller in the longitudinal direction.

10. The fixing device according to claim 8, wherein a length, in the moving direction, of a close portion of the heating pattern which corresponds to the narrow portion is less than a length, in the moving direction, of an apart portion of the heating pattern which corresponds to the wide portion.

11. The fixing device according to claim 8, wherein the heating pattern is located within a region occupied by the nip portion in the moving direction.

12. The fixing device according to claim 8, wherein at least one of an upstream edge and a downstream edge of the substrate in the moving direction has an arc shape.

13. The fixing device according to claim 8, wherein the substrate is metal.

* * * * *